United States Patent [19]

Tomita et al.

[11] 3,955,340

[45] May 11, 1976

[54] APPARATUS FOR BINDING BUNDLES OF SHEETS

[75] Inventors: Kahei Tomita, Kawasaki; Takeo Oshima, Himeji; Takashi Toda, Himeji; Mituo Ikemi, Himeji, all of Japan

[73] Assignee: Glory Kogyo Kabushiki Kaisha, Himeji, Japan

[22] Filed: July 23, 1974

[21] Appl. No.: 491,493

[30] Foreign Application Priority Data

July 23, 1973 Japan ..... 48-87207[U]
July 7, 1974 Japan ..... 49-64643

[52] U.S. Cl. ..... 53/199; 53/198 R
[51] Int. Cl.[2] ..... B65B 13/04
[58] Field of Search ..... 53/198 R, 199

[56] References Cited

UNITED STATES PATENTS 1,123,606 1/1915 Smith ..... 53/198 R X
2,030,879 2/1936 Kleinberg ..... 53/199
3,248,849 5/1966 Hanson ..... 53/198 R X

*Primary Examiner*—Willie G. Abercrombie
*Assistant Examiner*—Leon Gilden
*Attorney, Agent, or Firm*—Wenderoth, Lind & Ponack

[57] ABSTRACT

A bundle of bills or like sheets to be bound is clamped between a pair of holder plates and is revolved therewith to a predetermined angular position, where the leading end of a tape is inserted into the bundle of sheets through one edge thereof by tape and insertion means comprising a movable separator finger and tape guide plate. This tape, having a layer of a thermoplastic synthetic resin adhesive coated on one surface thereof, is wound around the bundle of sheets as the same is further revolved with the holder plates. Tape bonding means including a heater pad is provided for thermally fastening the loose end of the tape wound around the bundle of sheets.

8 Claims, 15 Drawing Figures

APPARATUS FOR BINDING BUNDLES OF SHEETS

BACKGROUND OF THE INVENTION

This invention relates to apparatus for automatically binding bundles of bills or like sheets of paper or similar material. It is understood that the term "sheets" as used herein and in the claims appended hereto represents all such articles that can be handled by this apparatus.

For the sake of convenience in handling, a large number of bills or the like are usually arranged in separate bundles each consisting of a given number of such bills or the like, with a tape or ribbon wound around each bundle. Conventionally, this operation of typing up each bundle of bills has been performed manually, at the expense of substantial time and labor.

On the other hand, there has been known and used apparatus for automatically binding packages or like objects, in which a tape or cord is guided around the object by an arm turning therearound. However, since this binding scheme requires a large free space around the object to be bound, the size of the apparatus inevitably increases. Adaptation of this prior art apparatus for binding bundles of bills or like sheets is therefore by no means a wise policy, because the apparatus for this purpose now under consideration is required to be a tabletop type and should therefore has to be as small in size as possible.

SUMMARY OF THE INVENTION

In view of the noted state of the art, it is an object of this invention to provide a novel and improved apparatus for automatically binding bundles of sheets with a tape, wherein each bundle of sheets (and not the tape) is revolved to permit the tape to be wound therearound, so that the apparatus is substantially minimized in size.

Another object of the invention is to provide apparatus of the character described wherein the tape is of the type that can be bonded thermally, so that each bundle of sheets can be tied up highly expeditiously.

A further object of the invention is to provide apparatus of the character described wherein the tape which has been supplied from its roll and wound around each bundle of sheets is first thermally bonded in place on a tentative basis and, after having been cut into a suitable length, is again thermally bonded for securely fastening the loose end of the tape, so that the sheets can be unloosenably bound together.

A further object of the invention is to provide apparatus of the character described wherein the tentative and final fastening of the loose end of the tape is accomplished by one and the same mechanism.

A further object of the invention is to provide apparatus of the character described wherein each bundle of sheets introduced into the apparatus is securely held between a pair of holder plates throughout the entire binding operation.

A further object of the invention is to provide apparatus of the character described wherein the thermal bonding of the tape wound around each bundle of sheets is performed over one of the holder plates which are made of sheet metal or like heat-resisting material, thereby protecting the sheets against the heat developed by the thermal bonding means.

A further object of the invention is to provide apparatus of the character described which includes means for inserting the leading end of the tape into each bundle of sheets through one edge thereof before the tape is wound around the latter, the leading tape end being so firmly caught by the bundle of sheets that there is practically no possibility of it coming off during the succeeding tape winding operation.

A still further object of the invention is to provide apparatus of the character described which includes means for regulating the position of the said one edge of the bundle of sheets relative to the tape end insertion means as the bundle is introduced into the apparatus, so that the leading end of the tape is inserted thereinto to an unvarying depth for all the various sizes of sheets to be handled by the apparatus.

Briefly summarized, the invention provides apparatus including sheet holder means which securely receives a bundle of sheets introduced into the apparatus and which is revolvable therewith. Tape supply means supplies toward the sheet holder means a tape having an adhesive layer of thermoplastic material on one surface thereof. The leading end of the tape is inserted by tape end insertion means into the bundle of sheets supported by the sheet holder means through one edge thereof, and this bundle of sheets is succeedingly revolved through a predetermined angle with the sheet holder means to permit the tape to be wound therearound. Tape bonding means is provided for thermally bonding the trailing end of the tape after the winding operation. The entire procedure can be fully automated.

The features which are believed to be novel and characteristic of this invention are set forth with particularity in the appended claims. The invention itself, however, both as to its organization and mode of operation, together with the further objects and advantages thereof, will be best understood from the following description taken in conjunction with the accompanying drawings showing some preferred embodiments of the invention.

DETAILED DESCRIPTION

Figure 1:
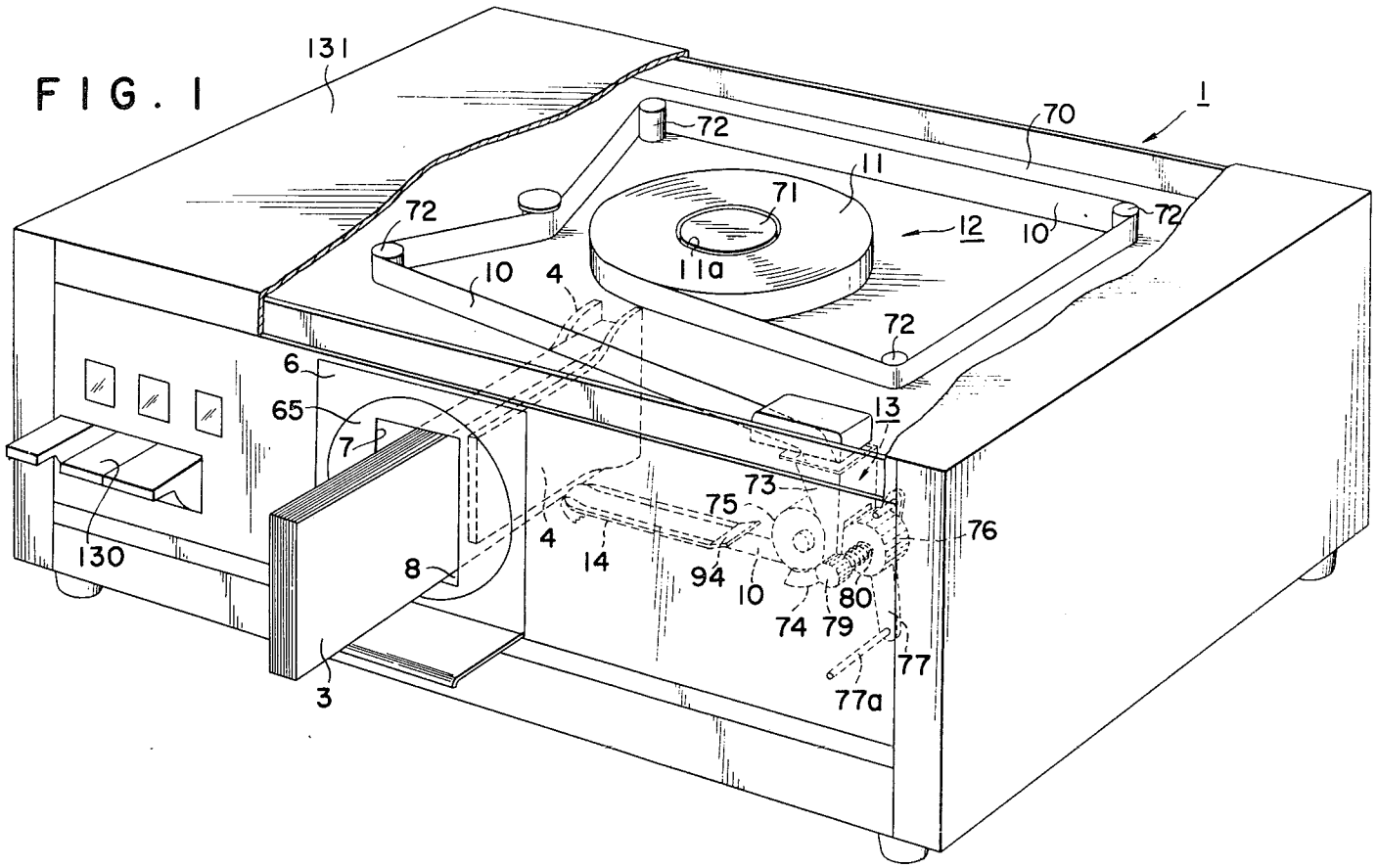
FIG. 1 is a partly broken away perspective view of the apparatus for binding bundles of sheets constructed according to the novel concepts of this invention.
Figure 2:
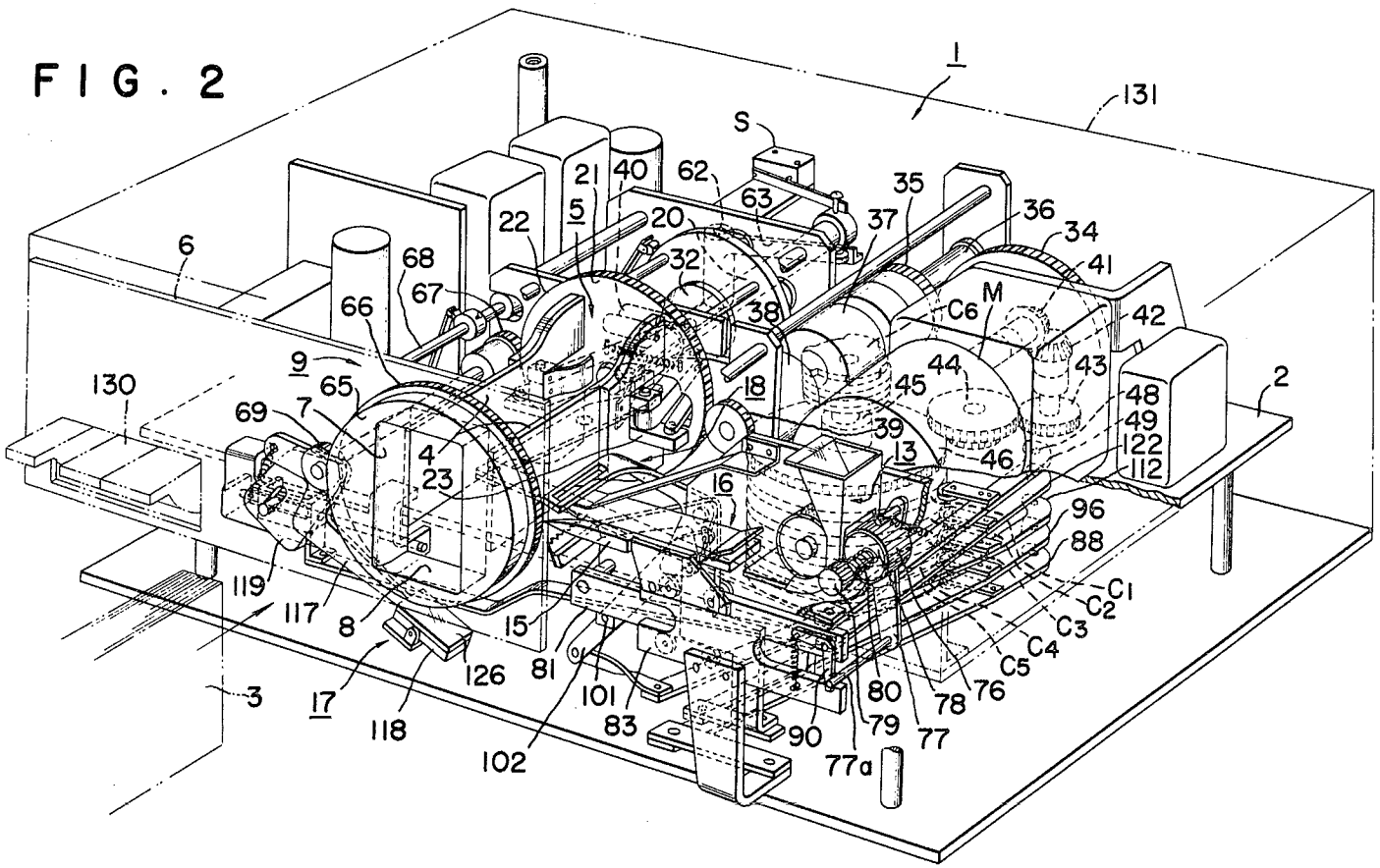
FIG. 2 is a perspective view of the apparatus shown in FIG. 1, in which the casing is not shown to reveal the inner details of the apparatus.

The general organization of a preferred form of the apparatus according to this invention will become apparent by referring to FIGS. 1 and 2. As will be seen from the following description, the apparatus generally designated by the numeral 1 in these drawings is composed of a plurality of operating mechanisms each comprising several constituent parts.

A sheet holder mechanism 5 includes a pair of holder plates 4 arranged in parallel spaced relationship over a base plate 2 for holding therebetween a pack or bundle of sheets 3 to be tied. A sheet position regulator mechanism 9 includes a rectangular aperture 7 formed through a regulator member 65 rotatably supported by a vertical frame member 6, the aperture 7 being adapted to permit the bundle of sheets 3 to be introduced therethrough into the apparatus. A surface 8 defining one of the edges of the aperture 7 is utilized for determination of the position of the bottom edge of the bundle of sheets 3.

A tape roll support section 12 and a tape delivery section 13 constitutes in combination a tape supply mechanism. Housed in the tape roll support section 12 is a roll 11 of elongate tape 10 which is of paper having a coating of a thermoplastic synthetic resin adhesive on one surface thereof. The tape 10 unwound from its roll 11 is to be fed via the delivery section 13 to the bundle of sheets 3 supported by the sheet holder mechanism 5.

A tape end insertion mechanism 16 comprises a guide plate 14 and a separator finger 15. The guide plate 14 carries the leading end of the tape 10 into an intersheet space formed by the separator finger 15 through that edge of the bundle of sheets 3 which is partly abutting against the aforesaid surface 8. The loose end of the tape which has been succeedingly wound around the bundle of sheets and which has been severed from the remainder of the tape by a tape cutter mechanism 18 is thermally joined with parts of the severed tape by the tape bonding mechanism 17 through two successive steps of tentative and final bonding operations. A drive mechanism including an electric motor M provides the necessary driving force for the operation of the listed mechanisms.

As illustrated in FIGS. 2 to 5, the sheet holder mechanism 5 includes a disc 21 having teeth 22 on its circumference and adapted to be rotatable about the axis of a rotatable shaft 20. A pair of pusher arms 24 loosely extending through the disc 21 are pivotally supported by respective pins 26 on a bracket 23 fixedly carried by the disc 21 so as to be bilaterally symmetrical with respect to the axis of the shaft 20. A pair of auxiliary arms 25 are also pivotally pinned at 27 to the bracket 23 in parallel with respective pusher arms 24. The arms 24 and 25 are further pivotally pinned at 29 and 30, respectively, to a pair of brackets 28 affixed to the respective holder plates 4. Thus, by virtue of the parallelogrammatic linkage systems formed by the arms 24 and 25, the pair of holder plates 4 are caused to move toward and away from each other with their parallel relationship unchanged, as later described in more detail.

The pusher arms 24 carry rolls 31 respectively at their rear ends, that is, those ends located away from the aforesaid rectangular aperture 7 through which the bundle of sheets to be tied is inserted into the apparatus. These rolls 31 are urged by a tension spring 33 into abutting contact with a cam 32 in the shape of a truncated cone (hereinafter referred to as the conic cam) that is fixedly mounted on the rotatable shaft 20.

The toothed disc or gear 21 meshes with a pinion 39 to be driven via clutch 37 and brake 38 by a rotatable shaft 36 which in turn is driven by the motor M via intermeshing gears 34 and 35. When the clutch 37 is engaged, therefore, the rotation of the motor is conveyed to the toothed disc or gear 21 thereby rotating the bundle of sheets 3 supported by the holder plates 4 and hence causing the tape 10 to be wound therearound.

The rear end of the shaft 20 is operatively associated with means for causing the back-and-forth motion of the conic cam 32 in order to vary the force with which the holder plates 4 are urged toward each other. This means includes pressure regulating means 40 whereby the pressure exerted against the bundle of sheets via the holder plates 4 is regulated in two stages to make possible the preliminary (or loose) and final (or tight) clamping of the sheets.

Figure 6:
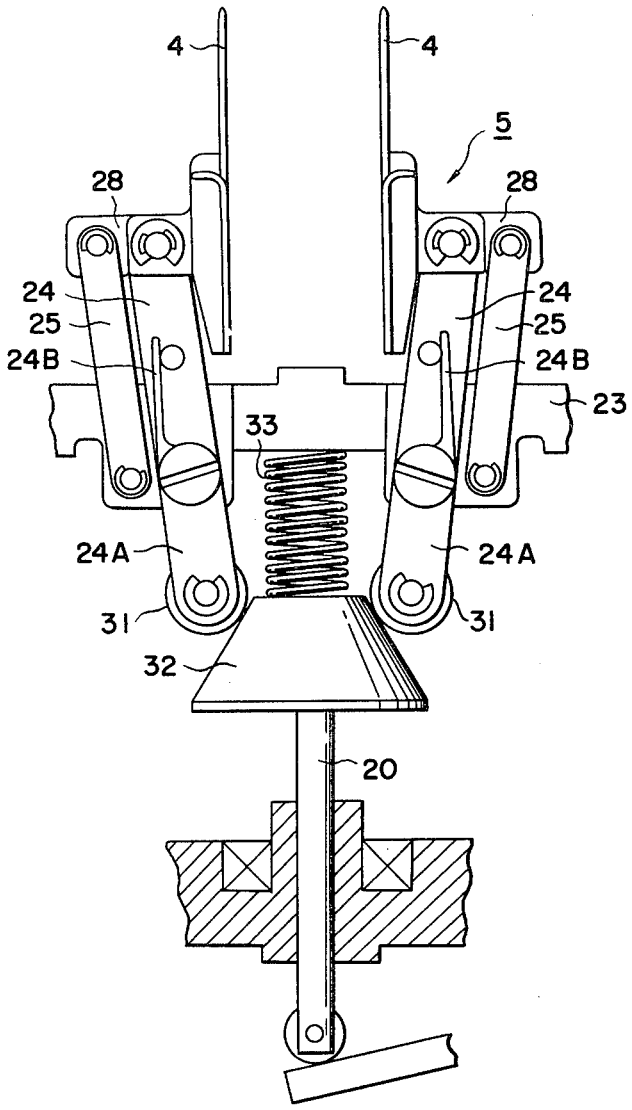
FIGS. 6(A) and 6(B) are top plan views showing an alternative form of the sheet holder mechanism.
Figure 6:
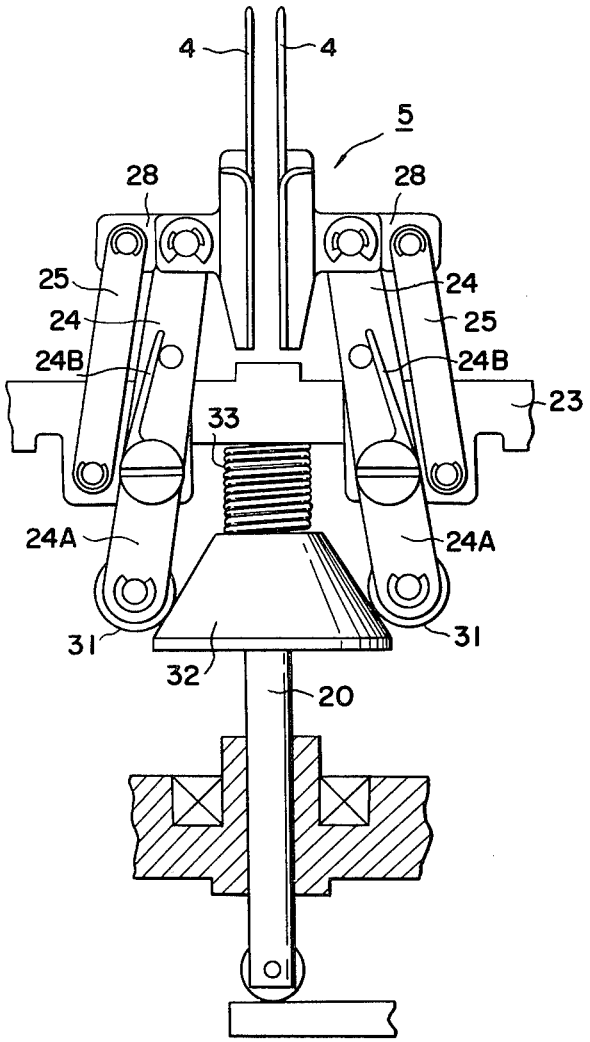

FIGS. 6(A) and 6(B) illustrate an alternative arrangement of the sheet holder mechanism 5, in which the pusher arms 24 terminate at the respective pins 26 and are thereby joined to extensions 24A via leaf springs 24B, respectively. These extensions 24A carry the respective cam follower rolls 31 abutting against the conic cam 32. A compression spring 33 is mounted between the bracket 23 and the conic cam 32. Thus, when the conic cam 32 is moved forward against the bias of the compression spring 33, the holder plates 4 are urged toward each other. When the conic cam is caused to be retracted by the compression spring, on the other hand, the holder plates move away from each other under the influence of the leaf springs 24B. This alternative arrangement is advantageous in that if an undue pressure is exerted against the bundle of sheets between the holder plates 4 because of, for example, its excessively great thickness, then the pusher arms 24 will flex outward against the forces of the leaf springs 24B. Any excessive pressure can thus be absorbed by the leaf springs 24B, so that the bundle of sheets can always be clamped by the holder plates 4 under appropriate pressure.

Referring back to FIG. 2 in particular, the drive shaft of the motor M is connected via intermeshing bevel gears 41 and 42 and intermeshing spur gears 43, 44, and 46 to a camshaft 45 on which there are fixedly mounted a plurality of planar cams $C_1$ to $C_5$. Also fixedly mounted on the camshaft 45 is a group of planar timing cams $C_6$ adapted for timing the operations of the clutch 37 and brake 38 in a controlled manner. These cams are so shaped as to connect or disconnect associated switches, not shown, in accordance with the timing chart shown in FIG. 13, as later described in more detail.

Figure 4:
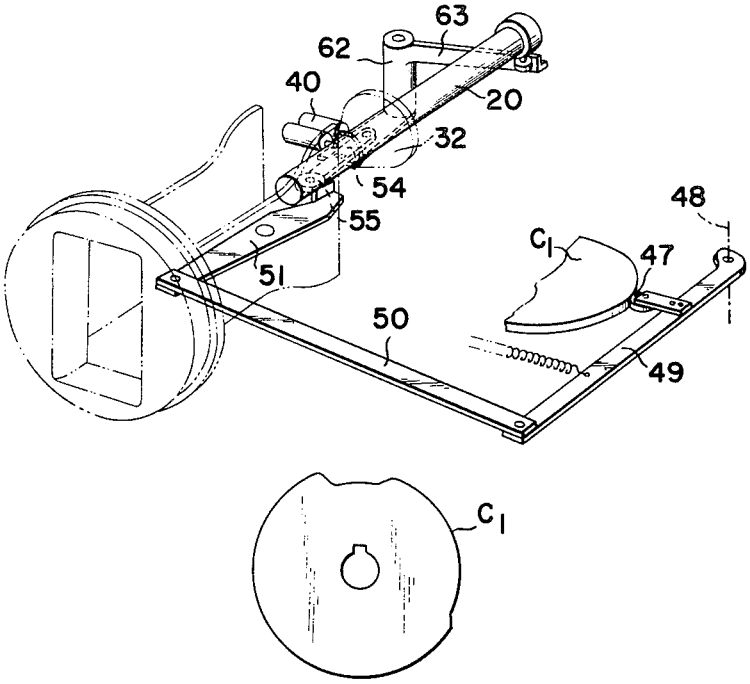
FIG. 4 is a perspective view of pressure regulating means associated with the sheet holder mechanism shown in FIG. 3.
Figure 5:
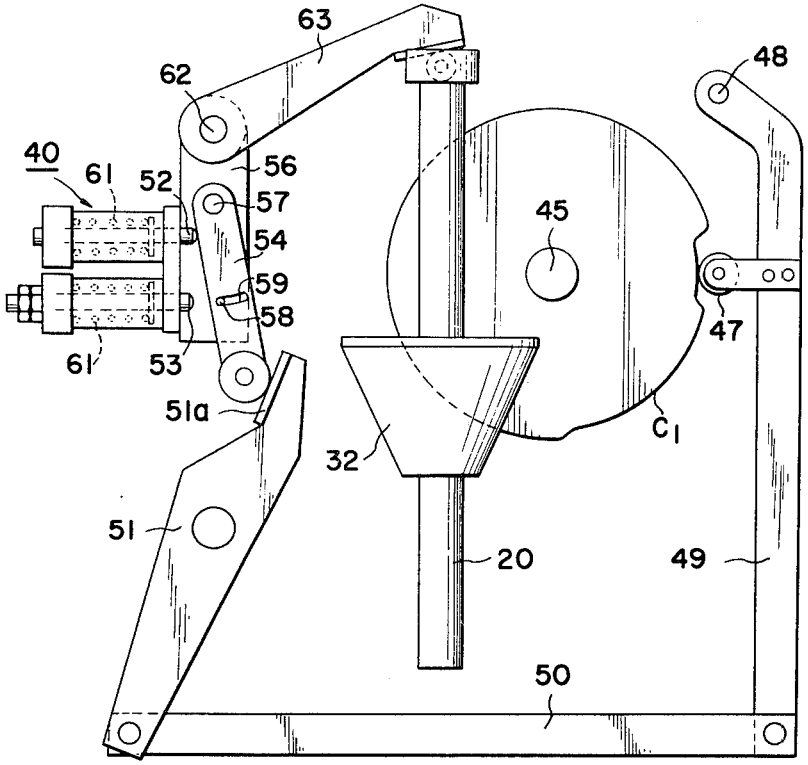
FIG. 5 is an enlarged top plan view of the pressure regulating means shown in FIG. 4.

As best shown in FIGS. 4 and 5, the cam $C_1$ is associated with the sheet holder mechanism 5. A lever 49 pivotally supported by a pin 48 at one end thereof carries a cam follower roll 47 which is urged by a spring against the stepped circumference of the cam $C_1$. The other end of this lever 49 is pinned to a link 50 and thence to a lever 51 terminating in an abutment 51*a*. Disposed opposite to this abutment 51*a* is a roll 55 mounted on one end of a lever 54 which at the other end is pivotally connected by a pin 57 to a pressure regulator lever 56. The angle of swing of the lever 54 relative to the pressure regulator lever 56 is limited by a pin 58 slidably received in an arcuate slot 59. Arranged on one side of the lever 54 are rods 52 and 53 of the pressure regulating means 40 which are associated with respective compression springs 61 to offer predetermined different degrees of resistance to the clockwise swing, as seen in FIG. 5, of the lever 54.

The pressure regulator lever 56 is fixedly coupled at its rear end to a rotatable shaft 62 which is mounted vertically on the base plate 2. An arm 63 extending horizontally from the top of the rotatable shaft 62 is arranged in abutting relationship to the rear end of the shaft 20 to exert therethrough a forward pressure on the conic cam 32. Extending axially through the shaft 20 is a switch actuator rod 64, FIG. 3, which is adapted to actuate a starter switch S when the bundle of sheets 3 is manually inserted into the sheet holder mechanism 5. Although not specifically illustrated, it is assumed that the sheet holder mechanism 5 is further provided with safety means whereby the gear 21 will not be actuated if the switch S is reclosed by accidentally pushing back the bundle of sheets S which has been completely tied together. The operation of this apparatus will be recommenced only after the tied bundle of sheets has once been completely withdrawn from the aperture 7.

As will be seen from FIGS. 1 and 2, the sheet position regulator mechanism 9 listed previously as one of the constituent mechanisms of the present apparatus includes a regulator member 65 which is rotatable in coaxial relationship to the gear 21. The regulator member 65 is substantially integrally provided with a gear 66 having the same number of teeth as the gear 21. The gear 66 meshes with a pinion 69 fixedly mounted on the same shaft 68 as a pinion 67 meshing with the gear 21, so that the gears 21 and 66 rotate synchronously.

With particular reference to FIG. 1, the tape roll support section 12 of the tape supply mechanism has a column 71 extending vertically upwardly from an inner cover plate 70 to be received in the central opening 11*a* of the tape roll 11. A plurality of guide rolls 72 are also mounted on the inner cover plate 70 for guiding the tape unwound from its roll. The tape delivery section 13 includes a cross-sectionally funnel-shaped tape guide 73 for guiding therethrough the tape 10 which has been unwound from its roll 11 and directed along the guides 72. A pair of feed rolls 75 and 76 are arranged on opposite sides of an arcuate tape passageway 74 joined to the tape guide 73.

The feed roll 76 has its circumference suitably overlaid with a sheet of rubber or like material capable of offering relatively high frictional resistance and is rotatably supported by a swingable arm 77 at a point slightly above its axis of swing. A brake disc 78 mounted on the shaft of the feed roll 76 is arranged for frictional contact with one of the end faces of the feed roll. An adjusting screw 79 is screw-threadedly mounted on the shaft of the feed roll 76, and a compression spring 80 is provided between the brake disc 78 and the adjusting screw 79. Thus, by manually turning the adjusting screw 79 relative to the shaft of the feed roll 76, the brake disc 78 imparts a variable degree of braking force against the rotation of the feed roll 76.

Figure 7:
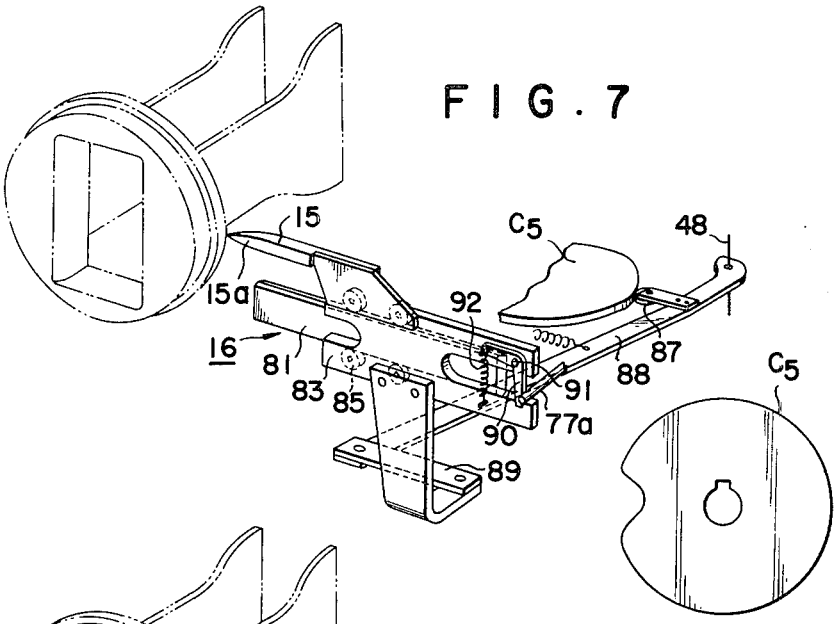
FIG. 7 is a perspective view of a separator finger and associated means constituting part of a tape end insertion mechanism in the apparatus shown in FIG. 1.
Figure 8:
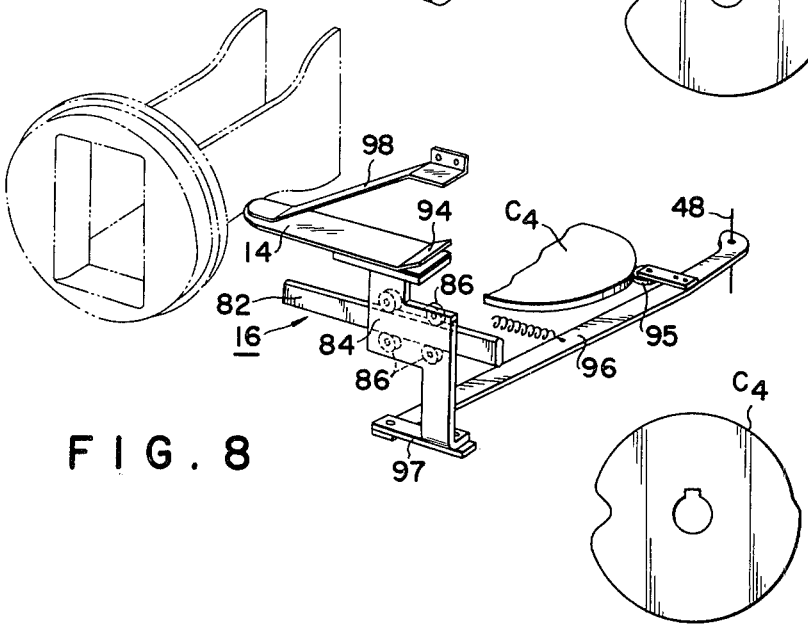
FIG. 8 is a perspective view of a guide plate and associated means also constituting part of the tape end insertion mechanism.

As illustrated in FIG. 2 and in more detail in FIGS. 7 and 8, the tape end insertion mechanism 16 comprises rails 81 and 82 extending perpendicular to the holder plates 4 of the sheet holder mechanism 5. A carriage 83 for the separator finger 15 is mounted on the rail 81 via wheels 85, whereas a carriage 84 for the guide plate 14 is mounted on the other rail 82 via wheels 86. The separator finger 15 has a pointed tip 15*a* to be easily thrusted between the sheets held in a bundle between the holder plates 4.

As clearly seen in FIG. 7, the separator finger carriage 83 is connected via flexible link 89 to the free end of a lever 88 pivotally supported by the shaft 48. The lever 88 carries a cam follower roll 87 which is spring actuated into abutment against the circumference of the planar cam $C_5$. Thus, when the cam follower roll 87 is received in the indentation formed in the circumference of the cam $C_5$, the separator finger 15 is thrust forward, whereby its pointed tip 15*a* is inserted between two adjacent sheets of the sheets held by the holder plates 4.

Also as seen in FIG. 7, the separator finger carriage 83 is provided with a brake lever 90 which is pinned at 91 to its end portion remote from the separator finger 15. This brake lever 90 is biased by a tension spring 92 in the counterclockwise direction as seen in the drawing. The downwardly extending end of the brake lever 90 is thus urged into abutment against a rod 77*a* extending horizontally from the rear end of the aforesaid swingable arm 77 rotatably supporting the feed roll 76 of the tape delivery section 13. When the separator finger carriage 83 is in its retracted position away from the sheet holder mechanism 5, therefore, the brake lever 90 causes the feed roll 76 to be urged against the other roll 75 via the swingable arm 77 thereby tightly holding the tape 10 therebetween to tense that portion of the tape extending between these feed rolls and the bundle of sheets 3 supported by the sheet holder mechanism 5.

With reference to FIG. 8 in particular, the tape guide plate 14 mounted on the other carriage 84 is arranged side by side with the separator finger 15 in coplanar relationship. The guide plate 14 is in the form of a suitably thin strip of metal or the like and has its leading end portion particularly sharp-edged. A guide 94 is arranged at a suitable angle above the guide plate 14 in a position adjacent its trailing end in order to make sure that the tape 10 supplied from the tape delivery section 13 is fed straight along the guide plate 14.

The guide plate carriage 84 is connected via flexible link 97 to the free end of a lever 96 pivotally supported by the shaft 48. This lever 96 carries a cam follower roll 95 which is spring biased into abutment against the circumference of the planar cam $C_4$. Thus, when the cam follower roll 95 is received in the indentation formed in the circumference of the cam $C_4$, the guide plate 14 is partly inserted into the intersheet space which has been formed by the separator finger 15 in the above described manner. The reference numeral 98 in FIG. 8 indicates a guide of resilient material adapted to hold the tape 10 over the leading end portion of the guide plate 14.

Figure 9:
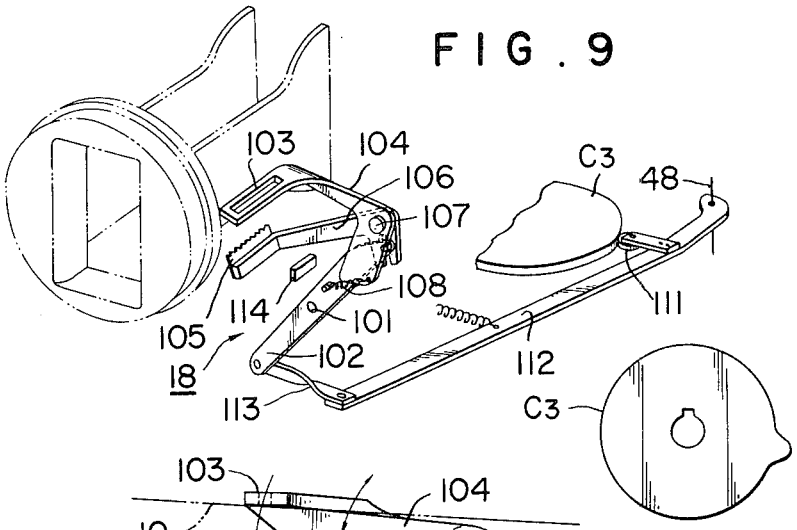
FIG. 9 is a perspective view of a tape cutter mechanism in the apparatus shown in FIG. 1.
Figure 10:
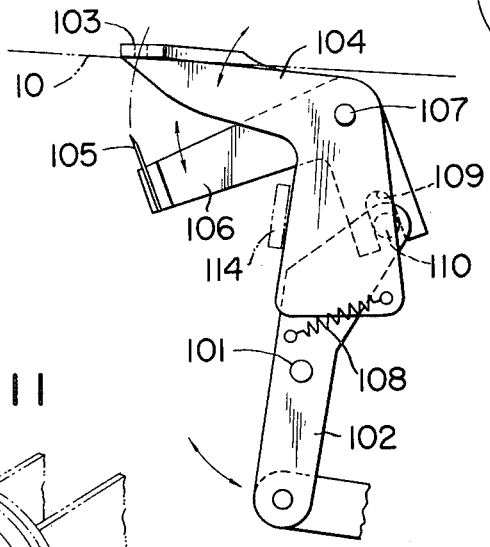
FIG. 10 is an enlarged side elevational view showing part of the tape cutter mechanism shown in FIG. 9.

As illustrated specifically in FIGS. 9 and 10, the tape cutter mechanism 18 includes a lever 102 pivotally supported at 101 so that its upper end portion is swingable toward and away from the sheet holder mechanism 5. Pivotally supported by a common pin 107 above the swingable lever 102 are two cooperative arms 104 and 106. The arm 104 has an elongate aperture or slot 103 therethrough, whereas the other arm 106 has a blade 105 with a sawtooth-like cutting edge adapted to project through the slot 103 of the arm 104 for cutting the tape 10. A tension spring 108 extends between the swingable lever 102 and the arm 104 so that the latter is swingable substantially simultaneously with the former. The arm 106 is slotted at 109 to slidably receive a pin 110 fixed to the swingable lever 102.

The lower end of the swingable lever 102 is connected via a flexible twisted link 113 to the free end of a lever 112 pivotally supported by the shaft 48. The lever 112 carries a cam follower roll 111 which is spring biased into abutment against the circumference of the cam $C_3$. The tape cutter mechanism operates each time the cam follower roll 111 rides over the protuberance on the circumference of the cam $C_3$. Reference numeral 114 in FIGS. 9 and 10 denotes a stop adapted to limit the swinging motion of the lever 102 so that the apertured end of the arm 104 will come into contact with the top surface of the tape 10 when the lever 102 abuts against the stop 114.

Figure 11:
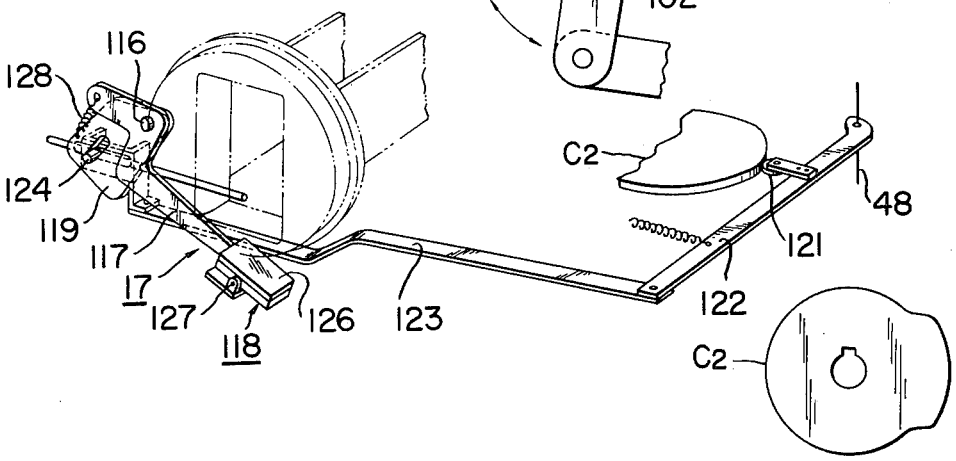
FIG. 11 is a perspective view of a tape bonding mechanism in the apparatus shown in FIG. 1.
Figure 12:
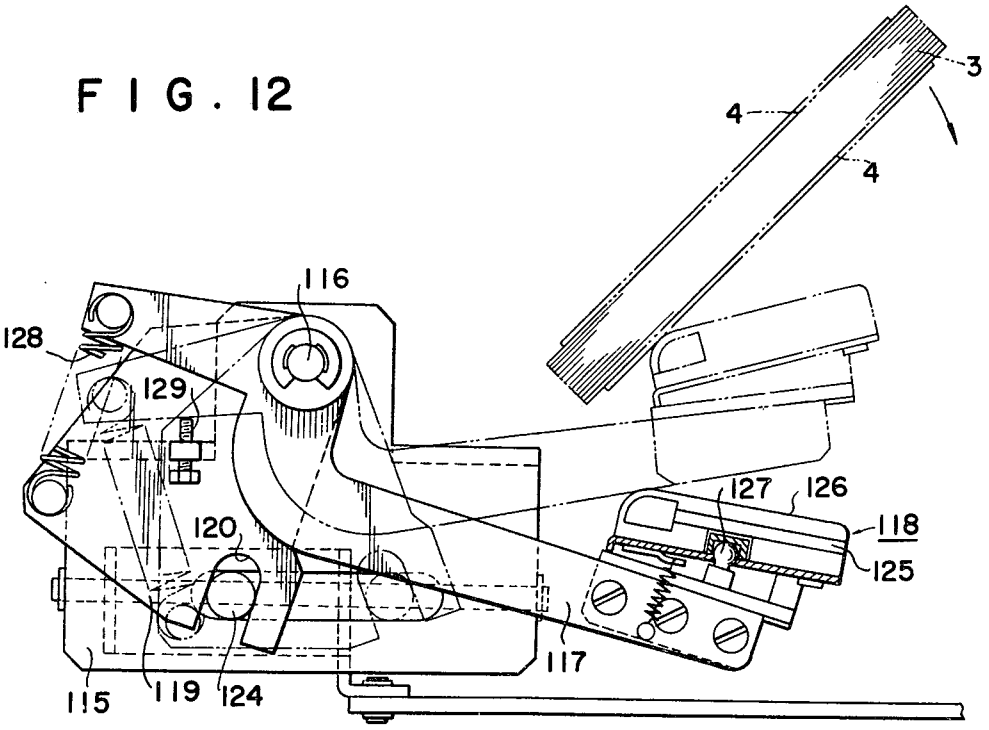
FIG. 12 is an enlarged side elevational view showing part of the tape bonding mechanism shown in FIG. 11, the view being also explanatory of the operation of the mechanism.

FIGS. 11 and 12 illustrate the details of the tape bonding mechanism 17. A heater pad 118 is mounted on the tip of an arm 117 pivoted at 116 to a frame member 115 so as to be movable between an operative position (indicated by the dot-and-dash lines in FIG. 12) for abutment against one of the holder plates 4 of the sheet holder mechanism 5 and an inoperative position (indicated by the solid lines) away from the path of the bundle of sheets 3 supported by the holder plates 4. To this end, an extended width lever 119 swingable simultaneously with the shaft 116 pivotally supporting the arm 117 is slotted at 120 to slidably receive a pin 124 fixed to a link 123 connected to the free end of a lever 122. Pivotally supported by the shaft 48, the lever 122 carries a cam follower roll 121 which is spring biased into abutment against the circumference of the cam $C_2$. The arm 117 swings to its operative position when the cam follower roll 121 rides over the protuberance on the circumference of the cam $C_2$.

The heater pad 118 has an electric heater 125 covered with a padding 126 of suitable material and is pivotally mounted at 127 on the tip of the arm 117. As the arm 117 swings to its operative position, therefore, the heater pad 118 first comes into contact with one of the holder plates 4 only at one of its end portions and gradually moves into complete contact therewith as the holder plates are displaced angularly. A tension spring is provided at 128 for interconnecting the arm 117 and lever 119. The upper limit of the swinging motion of the arm 117 is determined by an adjustable stop 129. Reference numeral 130 in FIGS. 1 and 2 indicates the manual control section of this apparatus, and 131 the casing of the apparatus.

Proceeding to the description of the operation of the above described embodiment of the invention, the tape 10 unwound from its roll 11 loaded in the tape roll support section 12 as shown in FIG. 1 must first be threaded along the guide rolls 72, inserted into the tape guide 73 so as to extend between the pair of feed rolls 75 and 76, and then directed over the guide plate 14 so that the leading end portion of the tape projects beyond the tip of the guide plate and extends downwardly therefrom. The power switch of the apparatus may then be manually closed, with the result that the clutch 37 becomes disengaged, and the brake 28 set in operation.

Figure 3:
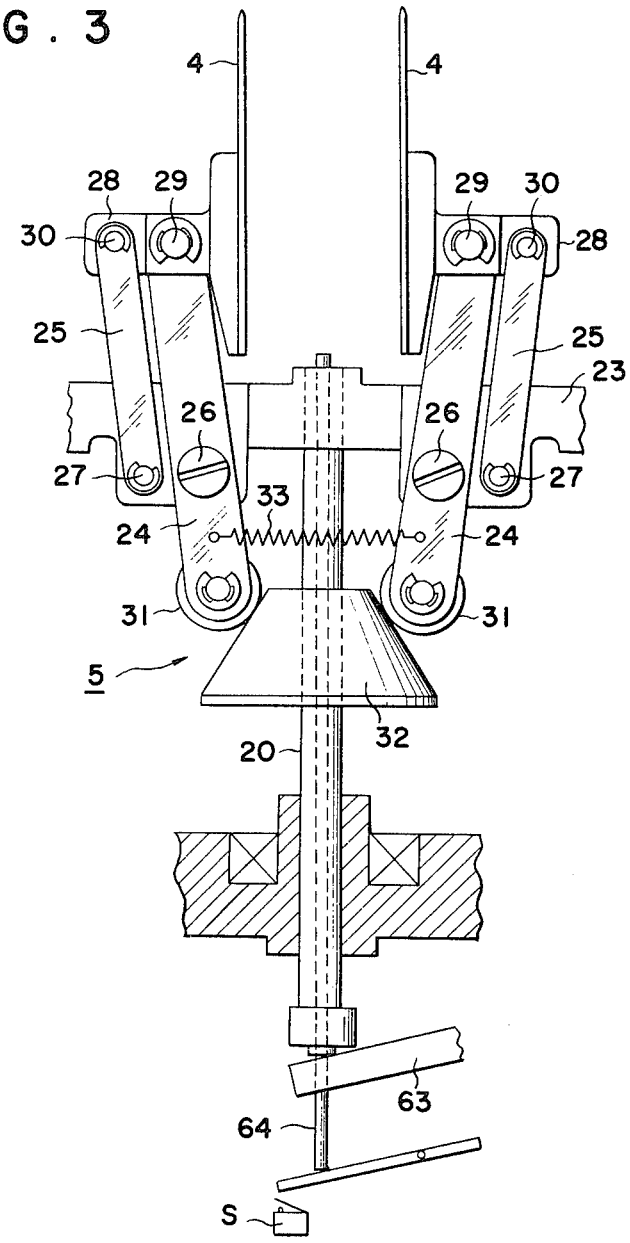
FIG. 3 is an enlarged top plan view of a sheet holder mechanism in the apparatus shown in FIG. 1.

The operator is now ready to insert the bundle of sheets 3 to be tied into the aperture 7 of the sheet position regulator mechanism 9 as illustrated in FIG. 1. With the bundle of sheets 3 fully forced into the aperture 7, the switch actuator rod 64, FIG. 3, is thrust rearwardly to actuate the startor switch S and hence to initiate the operation of the motor M. The rotation of the motor M is conveyed via the bevel gears 41 and 42 and the spur gears 43, 44, and 46 to the camshaft 45. The relative arrangement of the various cams on this camshaft 45 is such that the cam follower roll 47 of the lever 49, FIGS. 4 and 5, first rides over a circumferential portion of the cam $C_1$ such that the lever 54 is urged against the rod 52 for preliminary clamping operation via the lever 49, link 50 and lever 51. The arm 63 is thus caused to press the shaft 20 and, therefore, the conic cam 32, forward under pressure determined by the force of the spring 61 associated with the rod 52. As will be seen from FIG. 3, the forward thrust of the conic cam 32 results in the synchronized movement of the holder plates 4 toward each other via the cooperating pusher arms 24 and auxiliary arms 25, so that the bundle of sheets 3 is clamped by these holder plates.

With the bundle of sheets 3 thus supported under pressure between the holder plates 4, the group of timing cams $C_6$ on the camshaft 45 operates to release the brake 38 and to engage the clutch 37. The rotation of the motor M is now conveyed to the gear 21 and the gear 66, thereby causing the same to rotate synchronously with the regulator member 65. Upon rotation of 270° of the gear or toothed wheel 21 in the clockwise direction from its position shown in FIG. 1, indicated by the character A in the timing chart of FIG. 13, the group of timing cams $C_6$ actuates the brake 38 to temporarily halt the rotation of the bundle of sheets 3. In this temporarily stopped position, that edge of the bundle of sheets 3 which partly abuts against the surface 8 of the regulator member 65 is directed toward the tape end insertion mechanism 16.

When the rotation of the bundle of sheets 3 is stopped in the above noted angular position A, the cam follower roll 87 of the lever 88, FIG. 7, drops into the indentation of the cam $C_5$. Thereupon the separator finger carriage 83 is caused via the link 89 to advance toward the bundle of sheets 3, and the pointed tip 15*a* of the separator finger 15 forms the desired intersheet space in the aforesaid edge of the bundle of sheets 3.

Just about the time when the pointed tip of the separator finger 15 projects into the bundle of sheets 3 in the above described manner, the cam $C_4$ causes the lever 96 to swing clockwise, as seen in FIG. 8, on the shaft 48. The tape guide plate carriage 84 is thus caused to follow the separator finger carriage 83 and to move toward the bundle of sheets 3 immediately thereafter. As the guide plate 14 on the carriage 84 is thrust into the intersheet space that has been just formed by the separator finger 15, the leading end portion of the tape 10 is also inserted therein in a folded condition. In the meantime, the cam $C_5$ operates to retract the separator finger carriage 83 away from the bundle of sheets. The cam $C_4$ also operates to retract the guide plate carriage 84 away from the bundle of sheets 3, with only the leading end portion of the tape left therein. The foregoing description will be better understood by referring to FIG. 13 as well.

Figure 13:
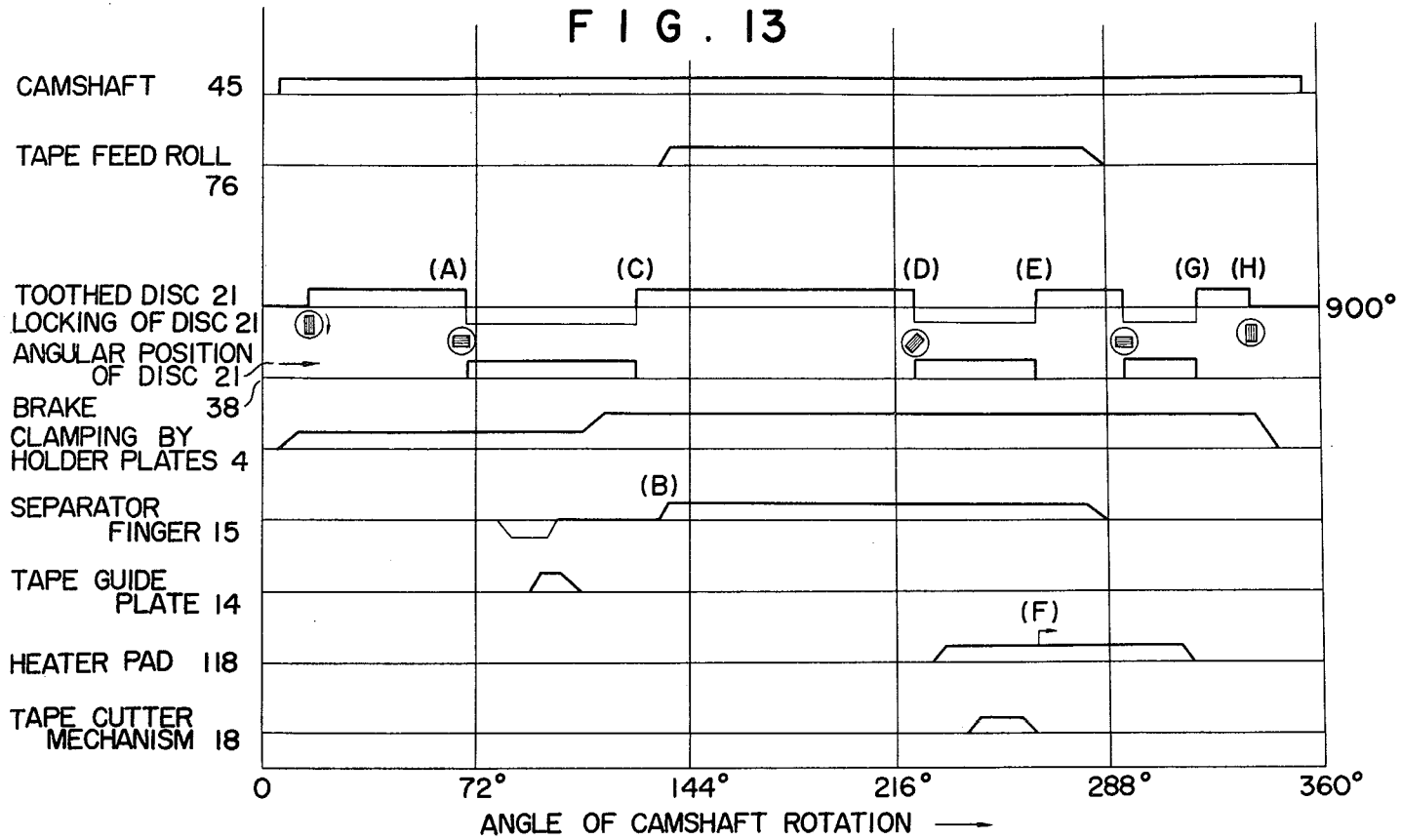
FIG. 13 is a timing chart representing the relative operating periods of the various parts of the apparatus shown in FIG. 1.

Upon completion of the insertion of the tape end into the bundle of sheets 3, the cam follower roll 47 rides over another circumferential portion of the cam $C_1$ for the final or tight clamping of the sheets by the holder plates 4 (indicated at B in FIG. 13). The lever 54 is now caused to turn further clockwise, as seen in FIG. 5, against the spring energized rods 52 and 53, so that the conic cam 32 is slightly urged forward to increase the clamping pressure of the bundle of sheets 3 by the holder plates 4.

The brake 38 is then released by the action of the timing cam group $C_6$ to recommence the rotation of the toothed disc 21 and regulator member 65 together with the bundle of sheets 3 tightly clamped by the holder plates 4 in the clockwise direction. During their 495° rotation (from C to D in FIG. 13) the tape 10 is wound around the holder plates 4 with the sheets 3 held therebetween and stops. Upon completion of this 495° rotation, the bundle of sheets 3 is angled 45° with respect to the horizontal plane and then stopped as indicated by the dot-and-dash lines in FIG. 12.

The cam follower roll 121 carried by the lever 122, FIG. 11, now rides over the protuberance of the cam $C_2$, with the result that the lever 119 is swung counterclockwise, as seen in FIG. 12, via the link 123 and pin 124. The arm 117 is thus caused to swing upward until the base end of the heater pad 118 abuts against the tape 10 wound around the bundle of sheets 3 and holder plates 4, also as indicated by the dot-and-dash lines in FIG. 12. Parts of the tape 10 are united together on a tentative basis as the heater pad 118 heats the thermoplastic synthetic resin adhesive coating on the rear or inside surface of the tape during the period of D to E in FIG. 13.

Only slightly after the foregoing operation of the tape bonding mechanism 17, the cam follower roll 111 carried by the lever 112, FIG. 9, rides over the protuberance of the cam $C_3$. The swingable lever 102 is thus swung counterclockwise, as seen in FIG. 10, via the link 113, so that the arm 104 also swings with the other arm 106 until the lever 102 comes into contact with the stop 114. The apertured end of the arm 104 is now located in contact with, or sufficiently close to, the upper surface of the tape 10. The counterclockwise swing of the lever 102 also results in the clockwise swing of the arm 106 via the pin 110 slidably received in the slot 109, so that the blade 105 moves upwardly and projects through the aperture 103 of the arm 104 thereby cutting the tape 10. The leading end of the tape lying on the guide plate 14 again hangs loosely from its tip.

Upon severance of the tape 10, the brake 38 is again released to permit rotation of the toothed disc or gear 21 until the bundle of sheets 3 is disposed horizontally, with the tentatively united portions of the tape directed downwardly. Simultaneously, the heater pad 118 starts pivoting from the point F in FIG. 13 in step with the angular displacement of the bundle of sheets 3 supported between the holder plates 4, until the entire top surface of the padding 126 abuts against the tape 10. The loose end of the tape which has been wound around the bundle of sheets and the holder plates is thus securely fastened in place by the thermal bonding operation effected by the heater pad 118. It may be worth mentioning here that the holder plates 4 are each made of relatively thin sheet metal of suitable resiliency.

Upon passage of a predetermined length of time, the arm 117 is caused to swing back to its inoperative position, indicated by the solid lines in FIG. 12, by the action of the cam $C_2$. The timing cam group $C_6$ again operates to release the brake 38 and to engage the clutch 37, so that the bound bundle of sheets 3 rotates with the holder plates 4 until the same assumes a vertical disposition. This rotating period extends from G to H in the timing chart of FIG. 13. The camshaft 45 has now undergone one complete revolution. The cam follower roll 47 carried by the lever 49, FIG. 5, rides over the smallest radius portion of the cam $C_1$, so that the conic cam 32 is spring actuated to its rearward inoperative position thereby relieving the bound bundle of sheets 3 of the clamping pressure that has been exerted by the holder plates 4. The operator is now ready to withdraw the bound bundle of sheets out of the aperture of the regulator member 65.

Figure 14:
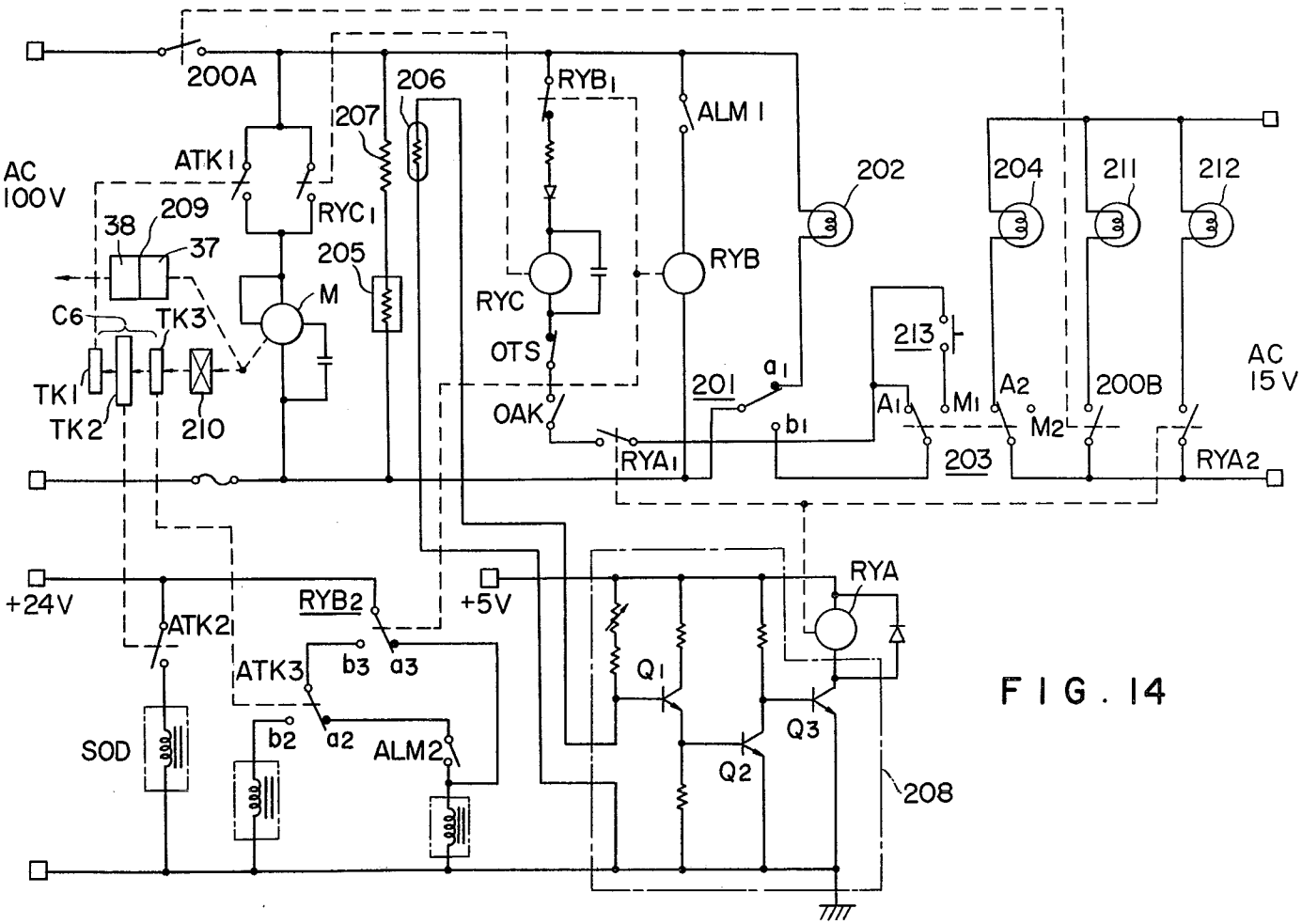
FIG. 14 is a schematic electrical diagram showing an example of electrical controls adapted for the apparatus shown in FIG. 1.

Described hereinbelow with reference to FIG. 14 are the electrical controls and the safety device in the above described embodiment of the invention. A power switch 200A is adapted for on-off control of the electric power supplies of the apparatus which are designated at AC 15V, +24V and +5V in the drawing. A selector switch 201 comprises a movable contact and a pair of fixed contacts $a_1$ and $b_1$, such that the movable contact will be closed against the fixed contact $a_1$ when the tape 10 unwound from its roll 11 is not fed onto the guide plate 14 via the tape delivery section 13 and against the other fixed contact $b_1$ when it is. A tape pilot lamp 202 is to be lit up when the movable contact of the selector switch 201 is closed against the fixed contact $a_1$ and, therefore, when the tape is not fed onto the guide plate 14.

A mode selector switch 203 is composed of two movable contacts associated with a pair of fixed contacts $A_1$ and $M_1$ and another pair of fixed contacts $A_2$ and $M_2$, respectively. The apparatus will be set in an automatic starting mode when the movable contacts of this mode selector switch are closed against the respective fixed contacts $A_1$ and $A_2$ and in a manual starting mode when the movable contacts are closed against the respective fixed contacts $M_1$ and $M_2$. A mode pilot lamp 204 is to glow when the apparatus is operating in the automatic starting mode.

The reference numeral 205 indicates the electric heater (labeled 125 in FIG. 12) of the heater pad 118. In order to detect the temperature of this heater 205, a thermistor 206 is arranged adjacent a vitreous enamel resistor 207 that is serially connected to the heater 205. A relay amplifier 208, composed of transistors $Q_1$ to $Q_3$ and so forth, is adapted to detect the change in the resistance of the thermistor 206 and to actuate a relay RYA when the temperature of the heater 205 exceeds a predetermined value. Relay contacts $RYA_1$ and $RYA_2$ will become closed upon energization of the relay RYA.

A transmission control generally designated by the numeral 209 comprises the clutch 37 and brake 38 which are adapted as aforesaid for selective transmission of the rotation of the motor M to the sheet holder mechanism 5. Indicated at $TK_1$ to $TK_3$ are the respective cams of the mentioned timing cam group $C_6$ which is rotated by the motor M via reduction gearing 210 comprising the gears 43, 44 and 46, as will be seen from FIG. 2. Timing cam switches $ATK_1$ and $ATK_2$ are adapted to be opened and closed in a controlled manner by the timing cams $TK_1$ and $TK_2$ respectively. Another timing cam switch $ATK_3$ comprises a movable contact and a pair of fixed contacts $a_3$ and $b_3$, such that the movable contact will be selectively closed to the fixed contacts in a controlled manner by the timing can $TK_3$.

A solenoid SoD is adapted to be energized upon closure of the timing cam switch $ATK_2$. A first limit switch $ALM_1$ is adapted to be opened or closed by a cam driven via the transmission control 209 in accordance with the energization and de-energization of the solenoid SoD. A relay RYB is to be energized upon closure of the first limit switch $ALM_1$ and is associated with a contact pair $RYB_1$ and with a contact set $RYB_2$. Another relay RYC is associated with a contact pair $RYC_1$. A second limit switch $ALM_2$ is adapted to be opened or closed by a cam rotated synchronously with the toothed disc or gear 21.

In the circuit configuration briefly explained in the foregoing, it is now assumed that the movable contacts of the mode selector switch 203 are closed against the fixed contacts $A_1$ and $A_2$ respectively, thereby setting the apparatus in the automatic starting mode. If now the power switch 200A is closed, a contact pair 200B interlocked therewith is also closed to light up a pilot lamp 211. The heater 205 simultaneously starts heating up. It will be understood that the heat being produced by the heater 205 corresponds to the temperature of the vitreous enamel resistor 207, which temperature is sensed by the thermistor 206. The electrical resistance of the thermistor 206 decreases in step with the rise in the temperature of the vitreous enamel resisistor 207, until at least the transistor $Q_1$ of the relay amplifier 208 becomes nonconductive whereas the transistor $Q_3$ becomes conductive. The relay RYA is thus energized to close its contact pairs $RYA_1$ and $RYA_2$, so that a temperature pilot lamp 213 is lit up.

As previously mentioned, the tape pilot lamp 202 indicates whether the tape is properly fed onto the guide plate 14 or not, the lamp glowing if it is not. Thus, if the temperature pilot lamp 212 is lit up, and if the tape pilot lamp 202 is unlit, then the operator is ready to insert a bundle of sheets to be bound into the aperture 7 of the tape holder mechanism 5. The contact pair OAK of the startor switch S, FIG. 3, is closed upon insertion of the bundle of sheets into the aperture 7. It is understood that when the bundle of sheets is thus inserted into the aperture 7, an operation detector switch OTS (to be described later) is held closed, and that the relay contact pair $RYB_1$ is also held closed.

Upon closure of the contact pair OAK, the relay RYC is energized to close its contact pair $RYC_1$ thereby initiating the rotation of the motor M. This motor rotation is imparted to the timing cams $TK_1$ to $TK_3$ via the reduction gearing 210, and the timing cam $TK_1$ first operates to close the timing cam switch $ATK_1$, so that the motor thereafter remains in rotation. The timing cam $TK_2$ succeedingly operates to close the timing cam switch $ATK_2$ and hence to energize the solenoid SoD. The first limit switch $ALM_1$ is thereby closed resulting in the energization of the relay RYB. About the time the solenoid SoD is energized as above stated, the conic cam 32, FIG. 3, operates to open the operation detector switch OTS, so that the relay RYC becomes deenergized. However, the motor M remains in rotation since the timing cam switch $ATK_1$ is held closed.

Upon energization of the relay RYB, its contact pair $RYB_1$ is opened whereas the movable contact of its contact set $RYB_2$ is switched from the fixed contact $a_3$ to the fixed contact $b_3$. The brake 38 is then released. The timing cam $TK_3$ also operates to cause the movable contact of the timing cam switch $ATK_3$ to switch from the fixed contact $a_2$ to the fixed contact $b_2$, so that the clutch 37 is engaged. The rotation of the sheet holder mechanism 5 is thus initiated, and the bundle of sheets 3 supported by the holder plates 4 is brought to the predetermined angular position for the start of the binding operation.

It may be noted that at this juncture, the timing cam $TK_2$ is caused to open the timing cam switch $ATK_2$ thereby de-energizing the solenoid SoD. The first limit switch $ALM_1$ is then opened, so that the relay RYB is de-energized to cause the movable contact of its contact set $RYB_2$ to switch from the fixed contact $b_3$ back to the fixed contact $a_3$. The clutch 37 is then disengaged, and the brake 38 engaged, thereby causing the bundle of sheets 3 supported by the holder plates 4 to stop in the predetermined angular position. The tape end insertion mechanism 16 is now operated in the above described manner to insert the leading end of the tape 10 into the intersheet space formed by the separator finger 15. During this operation, the movable contact of the timing cam switch $ATK_3$ is caused by the timing cam $TK_3$ to switch from the fixed contact $b_2$ to the fixed contact $a_2$.

Following the operation of the tape end insertion mechanism 16, the timing cam $TK_2$ operates to close the timing cam switch $ATK_2$ thereby energizing the solenoid SoD. The first limit switch $ALM_1$ is closed, and the relay RYB is energized, so that the movable contact of the relay contact set $RYB_2$ is again switched from the fixed contact $a_3$ to the fixed contact $b_3$. The brake 38 is therefore disengaged. The timing cam $TK_3$ also operates to cause the movable contact of the timing cam switch $ATK_3$ to switch from the fixed contact $a_2$ to the fixed contact $b_2$, resulting in the engagement of the clutch 37. The rotation of the sheet holder mechanism 5 is thus recommenced.

This rotation of the sheet holder mechanism must be stopped in the angular position where the tape 10 which has been wound around the bundle of sheets 3 is to be fastened on a tentative basis and to be cut into the required length. To this end the movable contact of the timing cam switch $ATK_3$ is caused by the timing cam $TK_3$ to switch from the fixed contact $b_2$ to the fixed contact $a_2$. Even though the clutch 37 is thereby disengaged, the sheet holder mechanism 5 continues rotating by inertia through a slight additional angle, until the brake 38 is engaged upon closure of the second limit switch $ALM_2$. With the bundle of sheets 3 thus stopped in the desired angular position, the tape 10 that has been wound therearound is fastened on a tentative basis by the tape bonding mechanism 17 and is further cut into the required length by the tape cutter mechanism 18.

Upon completion of these operations, the timing cam $TK_3$ operates to cause the movable contact of the timing cam switch $ATK_3$ to switch from the fixed contact $a_2$ to the fixed contact $b_2$, thereby disengaging the brake 38 and engaging the clutch 37. The rotation of the sheet holder mechanism 5 is thus recommenced. The second limit switch $ALM_2$ is opened immediately after resumption of the rotation of the sheet holder mechanism 5.

In order to finally and securely fasten the tape that has been wound around the bundle of sheets 3, the rotation of the sheet holder mechanism 5 must again be stopped via the second limit switch $ALM_2$ by switching the movable contact of the timing cam switch $ATK_3$ from the fixed contact $a_2$ to the fixed contact $b_2$. The tape is finally fastened in place over the bundle of sheets by the tape bonding mechanism 17 while the rotation of the sheet holder mechanism 5 is stopped. The rotation of the sheet holder mechanism is thereafter recommenced through the same procedure as that after the tentative fastening of the tape.

With the bundle of sheets 3 thus properly tied up, the rotation of the sheet holder mechanism must be arrested in the initial angular position (or in a position angularly displaced 180° therefrom). This objective can be accomplished by causing the timing cam $TK_2$ to open the timing cam switch $ATK_2$ and hence by de-energizing the solenoid SoD. The relay RYB also is de-energized, so that the movable contact of the relay contact set $RYB_2$ switches from the fixed contact $b_3$ to the fixed contact $a_3$, thereby disengaging the clutch 37 and engaging the brake 38. With the rotation of the sheet holder mechanism 5 thus arrested in the desired angular position, the timing cam $TK_1$ is caused to open the timing cam switch $ATK_1$, so that the motor M is now electrically disconnected from the power supply.

The operator may now withdraw the bound bundle of sheets out of the aperture 7 of the sheet holder mechanism 5. The contact pair OAK is opened upon partial withdrawal of the bound bundle of sheets from within the sheet holder mechanism 5. With further withdrawal of the bound bundle of sheets, the operation detector switch OTS is closed via the holder plates 4, so that the foregoing binding operation will be repeated if another bundle of sheets is succeedingly inserted into the aperture 7. However, unless the operation detector switch OTS is opened, the motor M will not be connected to the power supply if the bound bundle of sheets is accidentally pushed back into the aperture to close the contact pair OAK. This arrangement constitutes the safety means of the apparatus according to the invention.

The foregoing description of operation has been made on the assumption that the apparatus is in the automatic starting mode. For setting the apparatus in the manual starting mode, the movable contacts of the mode selector switch 203 may be closed against the respective fixed contacts $M_1$ and $M_2$. Consequently, the mode pilot lamp 204 is now unlit, and the motor M will not be set in rotation if the contact pair OAK is closed upon insertion of a bundle of sheets to be bound into the aperture 7. The motor rotation will be initiated only upon depression of a manual starting pushbutton switch 213 following the insertion of the bundle of sheets into the aperture 7. Once the motor M is started up in this way, the succeeding binding operation is exactly the same as when the apparatus is in the automatic starting mode.

Having thus described the several useful and novel features of the apparatus according to the invention, it is believed that the many objects for which it was designed have been fully accomplished. However, while the invention has been shown and described herein in very specific aspects thereof, many modifications of the invention may well occur to those skilled in the art within the broad teaching hereof. The invention, therefore, should be interpreted broadly and in a manner comprehensive of all such modifications remaining within the scope of the following claims.

We claim:

1. In an apparatus for binding a plurality of sheets in a neat bundle, comprising a casing, sheet holder means for holding a bundle of sheets to be bound, tape supply means for supplying a tape to said sheet holder means so as to permit said tape to be wound around said bundle of sheets, and tape bonding means for bonding the tape wound around said bundle of sheets, the improvement comprising revolving means for the sheet holder means for revolving said bundle of sheets relative to said casing, clamping means for clamping said bundle of sheets and pressure regulating means operatively associated with said clamping means for regulating the clamping pressure of said clamping means to two predetermined different degrees of pressure to cause relatively loose clamping of said bundle of sheets prior to the insertion of the loading end of said tape thereinto and relatively tight clamping of said bundle of sheets after the insertion of the loading end of said tape, tape end insertion means for inserting the leading end of said tape into said bundle of sheets through one edge thereof, said tape having an adhesive layer of thermoplastic material formed substantially integrally on one surface thereof, drive means coupled to said sheet holder means for revolving said sheet holder means with said bundle of sheets in a controlled manner so as to wind said tape around said bundle of sheets; and tape bonding means for thermally fastening said tape around said bundle of sheets.

2. An apparatus for binding a plurality of sheets as claimed in claim 1, in which the clamping means consists of a pair of holder plates in parallel spaced relationship to each other for holding said bundle of sheets therebetween, cam means for synchronously moving said holder plates toward and away from each other, and linkage means operatively connecting said holder plates to said cam means, said linkage means causing said holder plates to move synchronously toward and away from each other with their parallel relationship unchanged.

3. An apparatus for binding a plurality of sheets as claimed in claim 2, wherein said holder plates are made of a material capable of resisting the heat produced by said tape bonding means said tape bonding means being arranged so as to thermally fasten the tape wound around the bundle of sheets through one of said holder plates.

4. An apparatus as recited in claim 2, wherein said sheet holder means further includes a regulator member having an aperture therethrough for admitting the bundle of sheets to be bound into the apparatus, one of the surfaces defining said aperture being disposed in partly contacting relationship to said one edge of said bundle of sheets, whereby the position of said one edge of said bundle of sheets relative to said tape end insertion means can be held constant regardless of the size of the sheets.

5. An apparatus as recited in claim 1, wherein said tape supply means comprises:

a tape roll support section for supporting a roll of said tape; and a tape delivery section for delivering the tape unwound from said roll toward said sheet holder means.

6. An apparatus as claimed in claim 5, wherein said tape supply means further comprises tape cutter means for cutting said tape after the same has been wound around the bundle of sheets.

7. An apparatus as recited in claim 1, wherein said tape bonding means comprises:

a swingable arm;

a heater pad pivotally mounted on the free end of said swingable arm, said heater pad having a built-in electric heater; and means for imparting swinging motion to said swingable arm in relation to the angular position of said bundle of sheets.

8. An apparatus as recited in claim 1, wherein said tape end insertion means comprises:

a separator finger movable toward and away from said sheet holder means, said separator finger being adapted to project into said bundle of sheets through said one edge thereof in order to form an intersheet spacing therein;

means for moving said separator finger toward and away from said sheet holder means in relation to the angular position of said bundle of sheets;

a guide plate arranged in side-by-side relationship to said separator finger and also movable toward and away from said sheet holder means, said guide plate being adapted to carry the leading end of said tape into the intersheet formed by said separator finger; and means for moving said guide plate toward and away from said sheet holder means in relation to the motion of said separator finger.

* * * * *